US006253529B1

(12) United States Patent
De Boer

(10) Patent No.: US 6,253,529 B1
(45) Date of Patent: Jul. 3, 2001

(54) MOUNTING PLATE FOR A PARTITION SYSTEM

(76) Inventor: Hermanus Petrus Maria De Boer, Bongerd 90, 8212 Be Lelystad (NL)

( * ) Notice: Subject to any disclaimer, the term of this patent is extended or adjusted under 35 U.S.C. 154(b) by 0 days.

(21) Appl. No.: 09/355,476

(22) PCT Filed: Jan. 19, 1998

(86) PCT No.: PCT/NL98/00031

§ 371 Date: Aug. 20, 1999

§ 102(e) Date: Aug. 20, 1999

(87) PCT Pub. No.: WO98/33995

PCT Pub. Date: Aug. 6, 1998

(30) Foreign Application Priority Data

Jan. 31, 1997 (NL) ..... 1005145

(51) Int. Cl.[7] ..... E04B 2/00

(52) U.S. Cl. ..... 52/763; 52/36.5; 52/481.1; 52/779; 52/781

(58) Field of Search ..... 52/34, 36.4, 481.1, 52/36.5, 763, 777, 779, 781

(56) References Cited

U.S. PATENT DOCUMENTS 2,154,944 * 4/1939 Kullmer ..... 52/481.1
2,529,648 * 11/1950 Borton ..... 52/777
4,453,362 * 6/1984 Rodgers .
4,703,593 * 11/1987 Smolik ..... 52/34

FOREIGN PATENT DOCUMENTS

9401102 * 3/1994 (DE) .
9413917 * 11/1994 (DE) .
2041435 * 9/1980 (GB) ..... 52/777
2255386 * 11/1992 (GB) .

OTHER PUBLICATIONS

French technical brochure, XP 002040366, Sep. 1982.*

* cited by examiner

*Primary Examiner*—Blair M. Johnson
(74) *Attorney, Agent, or Firm*—Howard & Howard

(57) ABSTRACT

Reinforcement plate or mounting plate (12) for locally reinforcing a partition system, which wall comprises a number of uprights or pilars (8), and each pillar (8) of which comprises a C-shaped profile part, to which pillars (8) are attached wall parts, such as for example plaster-boards, in order in this way to form a partition (1). The reinforcement plate (12) comprises a planar metal plate which is provided with connecting means, with which the plate (12) can be connected with a clamping fit both to a first pillar (8), on one side, and to a successive pillar (8) on the other side. The connecting means comprise, on the one hand, hook-like members (17) and, on the other hand, gripping members (20), which hook members (17) can interact with an upright (8) and the gripping members (20) can interact with the next, second pillar (8), which is placed adjacent to the first pillar (8).

15 Claims, 4 Drawing Sheets

MOUNTING PLATE FOR A PARTITION SYSTEM

The invention relates to a reinforcement plate or mounting plate for locally reinforcing an assembled wall or partition system, comprising a number of pillars, which are placed at a specific distance from one another and each pillar of which comprises a C-shaped profile part, to which pillars are attached for example plasterboards, in order in this way to form a partition.

Large areas in buildings, houses, etc., frequently have to be split up into smaller areas. Partitions are put in position for this purpose. A known partition which can be put in position easily and rapidly comprises one or more U-shaped profile parts, which serve as joists and are placed on the floor where the partition is to be placed. Uprights or pillars, which comprise C-shaped profile parts, are then placed at regular distances from one another in the upwardly directed, open U-shape of the joist. Each pillar is placed with the opening on the same side. Panels, for example plasterboards, are then attached to the frame of the uprights or pillars. After one side of the wall has been provided with plasterboards, rock wool is arranged in the wall as a filling, whereupon the other side of the wall is covered with plasterboards.

A drawback of walls of this kind which comprise uprights covered with plasterboards is that it is not possible to attach anything to the wall between the pillars, since the plasterboards are only able to sustain a very light load.

To counteract this drawback, it is known to reinforce the wall in advance, before the plasterboards are attached, at the location where a washbasin, a tap or some other heavy item is later to be attached. For this purpose, a wooden panel is attached to the two successive uprights with the aid of bolts or screws. Attaching such panels entails considerable work and hence considerable extra cost.

The object of the invention is to provide a reinforcement plate for a wall composed of uprights to which a number of panels, such as plasterboards, are attached, which plate can easily be arranged between two successive pillars or uprights of a partition without having to use auxiliary means, such as bolts, screws or the like, with the result that objects such as a washbasin or the like can be attached to the wall at the location where the reinforcement plate is arranged.

This object according to the invention is achieved using a reinforcement plate by the fact that the reinforcement plate comprises a planar metal plate which is provided with connecting means, with which the plate can be connected with a clamping fit both to a first pillar, on one side, and to a successive pillar, on the other side.

Using a reinforcement plate of this kind according to the invention, it is possible to attach a metal plate to the desired locations to be reinforced after the uprights have been put in position or while the uprights are being put in position, it being possible to clamp or click this metal plate between two successive pillars using only clamping means. After the metal reinforcement plate has been attached, it is covered with the plasterboards and it is then possible to attach, for example, a washbasin, a tap or other items to the wall at the location where the reinforcement plate is arranged without the risk of the plasterboards crumbling on the outside wall of plasterboards.

In a preferred embodiment according to the invention, the connecting means which fasten the reinforcement plate to the uprights comprise, on the one hand, hook-like members and, on the other hand, gripping members, which hook members can interact with an upright and the gripping members can interact with the next, second pillar, which is placed adjacent to the first pillar. A reinforcement plate or mounting plate of this kind can be arranged between two pillars very quickly and without great difficulty, without using further auxiliary means.

Numerous other designs of reinforcement plates according to the invention are possible. Some of these are illustrated in the drawing.

The invention will be explained in more detail with reference to the drawing, in which.

Figure 1:
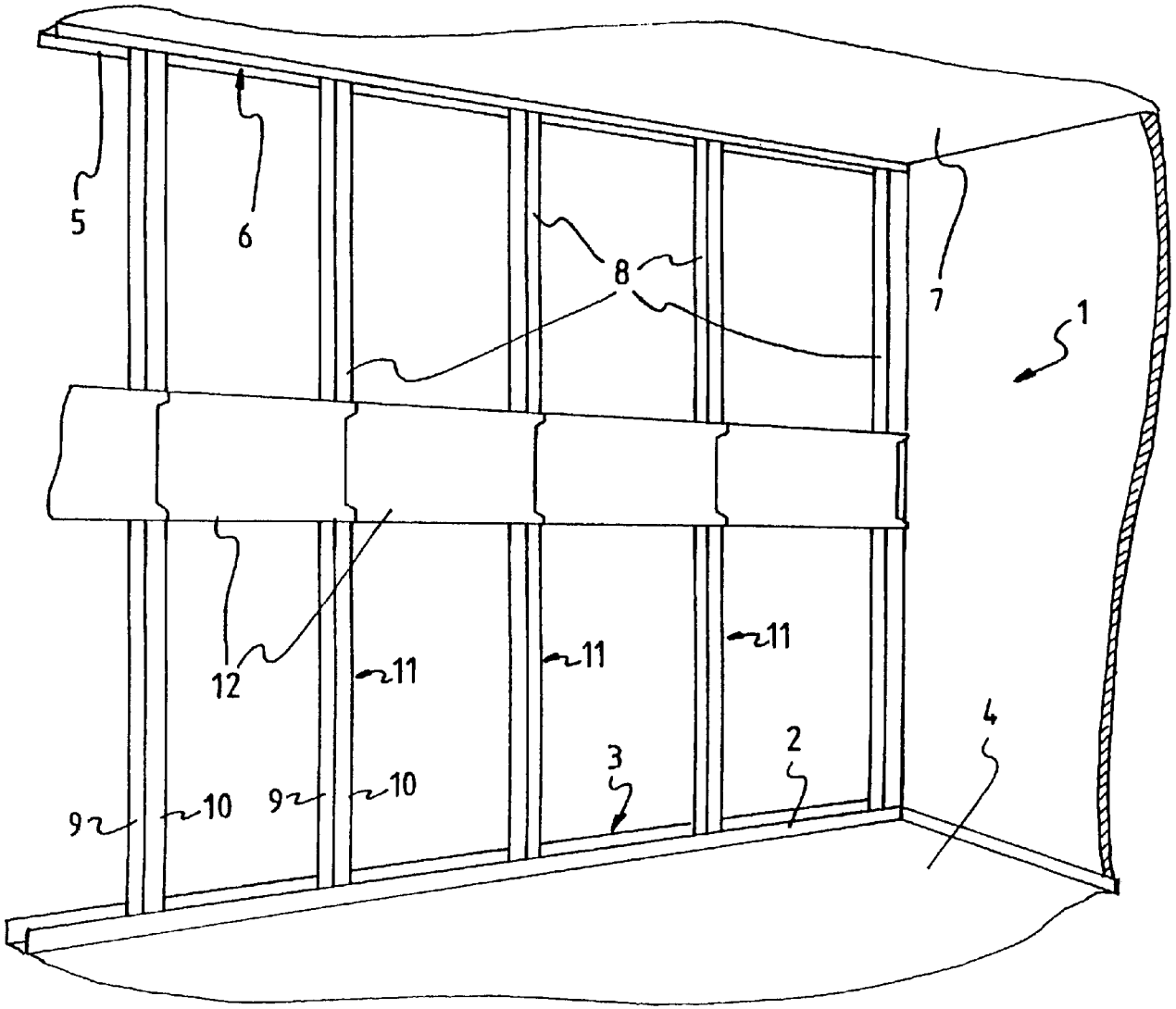
FIG. 1 shows the frame of a wall with a number of reinforcement plates according to the invention.

FIG. 1 shows a partition 1 to be constructed, comprising a U-shaped joist 2, which is attached to the floor 4 with the open side 3 facing upwards, and a U-shaped longitudinal joist 5, which is attached to the ceiling 7 with the open side 6 facing downwards. The upper joist 5 is placed directly above the lower joist 2, the open sides 3, 6 of the two joists 2, 5 facing towards one another. A number of uprights or pillars 8, which are formed from C-shaped section, are placed between the two U-shaped longitudinal joists 2 and 5, at a mutual distance which depends on the width of the panels which are to be attached to the up-rights 5. The C-shaped section of the uprights 8 comprises a rear wall 9, which is provided on both sides with side walls 10 and with an open side 11 situated opposite the rear wall. The open side 11 of all the uprights 8 always faces in the same direction. A number of reinforcement plates or mounting plates 12 according to the invention are arranged at the same height between in each case two successive uprights 8. These mounting plates 12 are made from sheet metal, for example sheet steel. Wall panels, for example plasterboards, are attached to the uprights 8 on both the front and the rear sides. After the wall panels have been attached to one side of the wall, a layer of insulating material, such as rock wool, is placed in the wall, after which the other side of the wall is covered with wall panels. Relatively heavy objects, such as for example a washbasin can be attached to the wall at the location of the mounting plate 12.

Figure 2:
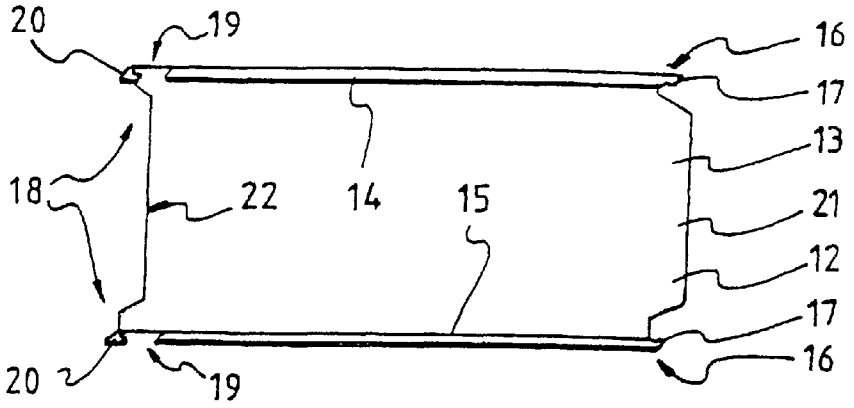
FIG. 2 shows a preferred embodiment of a reinforcement plate according to the invention.

FIGS. 2, 3, 4 and 5 show a number of possible embodiments of reinforcement plates 12 according to the invention. FIG. 2 shows a preferred embodiment of the reinforcement plate 12 according to the invention. The plate 12 comprises a surface 13 with a projecting upper edge 14 and a projecting lower edge 15, which are flanged at a right angle. The lower edge 15 and the upper edge 14 project in the same direction, so that the mounting plate 12 is planar on one side. One end 16 of both the upper edge 14 and the lower edge 15 is provided with a hook-like member or part 17. An L-shaped opening 19 is made in the region of the other end 18 of both the upper edge 8 and the lower edge 9, leaving a gripping member in the form of an L-shaped part 20, which serves to hook around the edge of the side wall 10 on the open side 11 of a C-shaped upright 8. Between the ends 16 of the upper edge 14 and the lower edge 15, the surface 13 comprises a trapezoidal widening 21. A cutout 22, the periphery of which essentially corresponds to the periphery of the widening 21, is made in the surface 13 at the side situated opposite to this widening 21. This embodiment is illustrated in more detail in FIGS. 6 to 9. As illustrated in FIG. 9, the open side 11 of the upright 8 is bordered on either side by a flanged edge 23 of the side walls 10. Two mounting plates 12 are arranged on either side of two adjacent uprights 8. The side wall 10 of one of the uprights 8 is accommodated in the L-shaped openings 19 at the end 18 of the upper edge 14 and the lower edge 15. The L-shaped part 20 thus engages around the flanged edge 23 of the upright 8. At the other end of the mounting plate 12, the side wall 10 of the upright 8 is clamped between, on the one hand, the widening 21, which is situated on the outside of the upright 8, and the flanged hook-like part 17. This hook-like part 17 comprises an extension 24 of the upper and lower edges 14, 15, respectively. This extension 24 has a narrowed end 25. A small cutout 26 is made between the narrowed end 25 and the remaining part of the extension 24. When the side wall 10 of an upright is pushed between the widening 21 and the narrowed end 25 of the hook-like part 17, the flanged edge 23 of the upright 8 is received in the cutout 26 and is enclosed between the hook-like part 17 and the widening 21.

Figure 6:
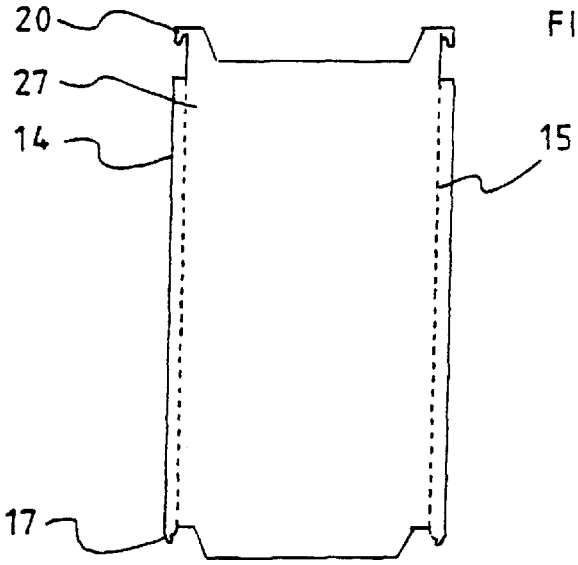
FIG. 6 shows the preferred embodiment as illustrated in FIG. 2 of the reinforcement plate according to the invention in the unfolded state.
Figure 7:
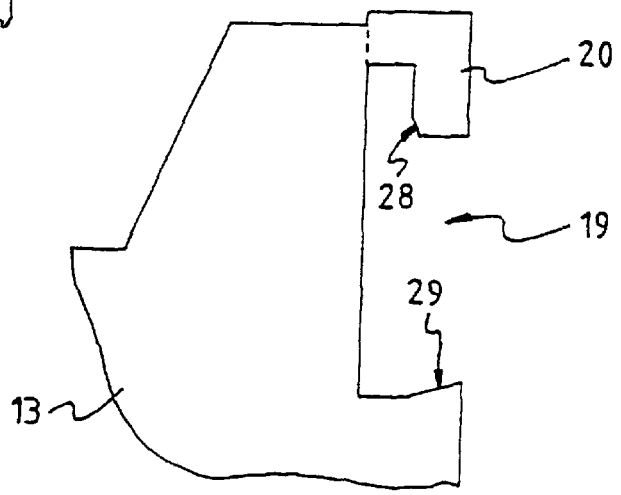
FIG. 7 shows a detail of the reinforcement plate in accordance with FIG. 6.

FIG. 6 shows a blanked plate 27, from which a mounting plate 12 can be produced by flanging the edges 14, 15. FIG. 7 shows in detail the L-shaped part 20 and the adjacent L-shaped opening 19, in the unfolded state of the mounting plate 12. In order to attach the side wall 10 of an upright 8 in the L-shaped opening 19, the flanged edge 23 of the upright 8 is first pushed into the opening 19 until it lies behind the L-shaped part 20. To simplify this operation, the L-shaped part 20 is provided with a bevel 28. The side wall 10 of the upright 8 is then rotated in the opening 19 until the side wall 10 strikes the edge of the surface 13. The upper edge 14 and the lower edge 15 are provided with an inclined side 29 on the sides which adjoin the openings 19. After the side wall 10 has been attached in the L-shaped opening 19, the end of the inclined side 29 clamps against the rear wall 9 of the upright 8. As shown in FIG. 9, the rear wall of the upright 8 is often slightly recessed locally, in order to provide the upright 8 with greater rigidity. The inclined side 29 should therefore be matched to the shape of the rear wall 9 of the upright 8, and should project sufficiently far into the L-shaped opening 19 for the corner of the inclined side 29 to bear against the rear wall 9 after the mounting plate 12 has been attached, even if this rear wall is set back slightly at that location.

Figure 8:
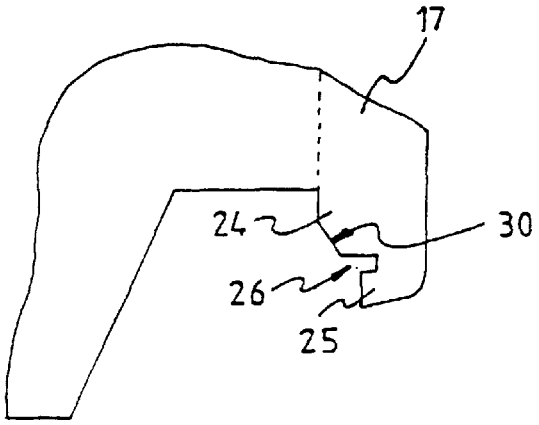
FIG. 8 shows another detail of the reinforcement plate in accordance with FIG. 6.
Figure 9:
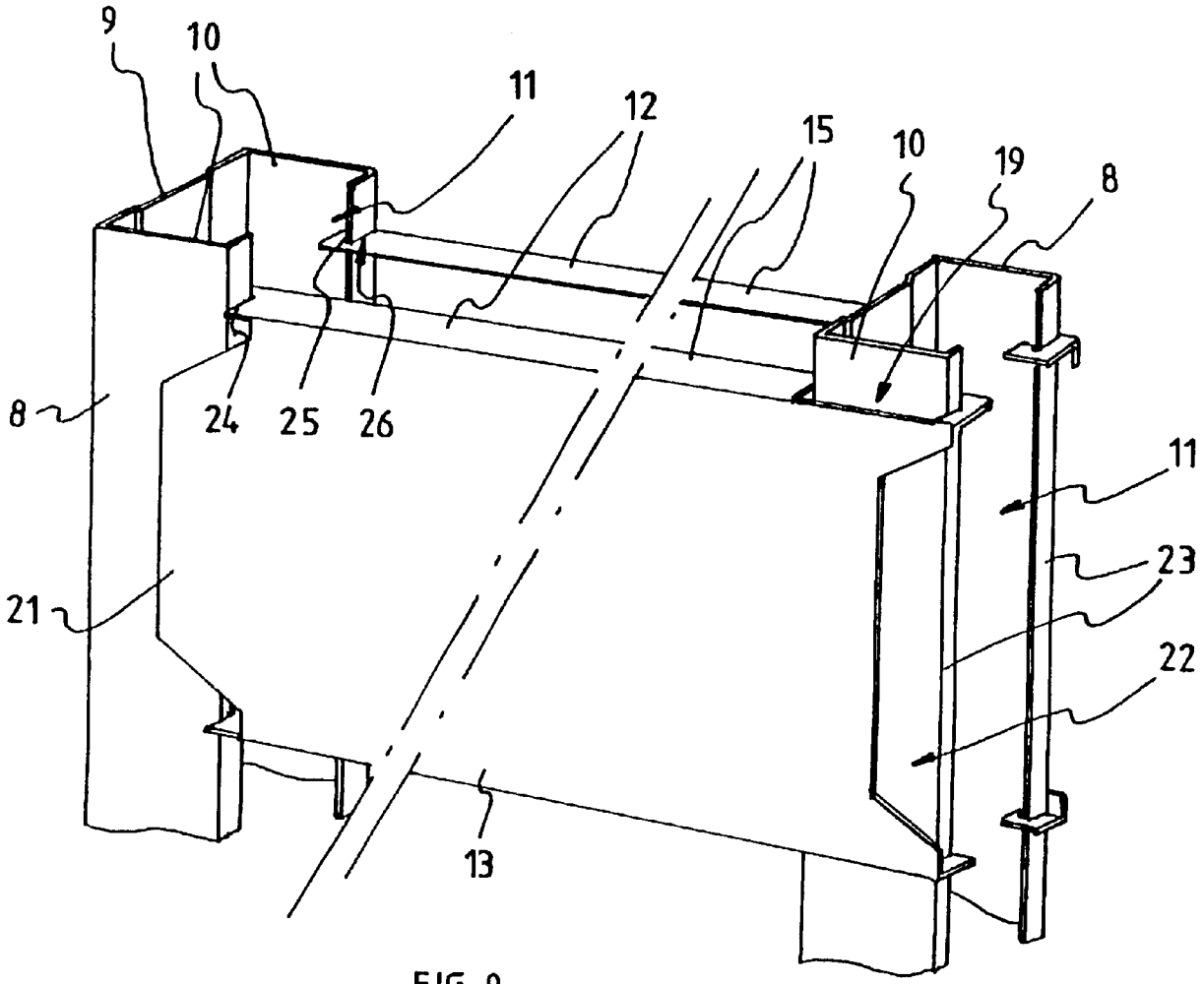
FIG. 9 shows two uprights of a partition, with reinforcement plates in accordance with FIG. 2 placed between them.

The hook-like part 17 is illustrated in detail in FIG. 8. The extension 24 comprises a bevelled side 30 just in front of the cutout 26. The narrowed end 25 is rounded slightly, in order to avoid sharp corners.

Figure 3:
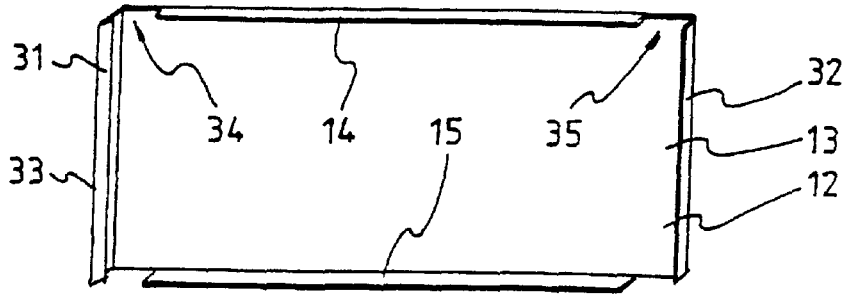
FIG. 3 shows another possible embodiment of a reinforcement plate according to the invention.

FIG. 3 shows another embodiment of a reinforcement plate according to the invention. This plate 12 too comprises a surface 13 with an upper edge 14 and a lower edge 15 which are flanged at a right angle. According to this embodiment, the reinforcement plate 12 comprises a flanged edge 31, 32 on both side edges. The outer edge 33 of the edge 31 is flanged again at an angle of greater than 90 degrees. Openings 34, 35 are left between the two ends of the flanged upper edge 14 and the lower edge 15 and the two flanged side edges 31, 32, in which openings the side wall 10 of an upright 8 can be received. By flanging the edges 31, 32 at an angle of more than 90 degrees, the edges can clamp firmly against the uprights 8. However, this embodiment has the drawback that it is no longer possible to place a plurality of plates at the same height between successive uprights 8.

Figure 4:
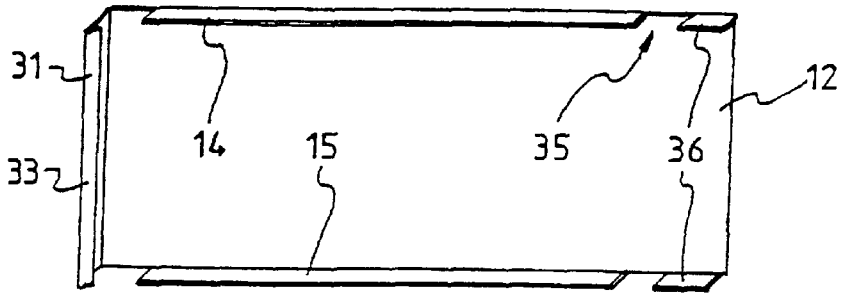
FIG. 4 shows a third possible embodiment of a reinforcement plate according to the invention.
Figure 5:
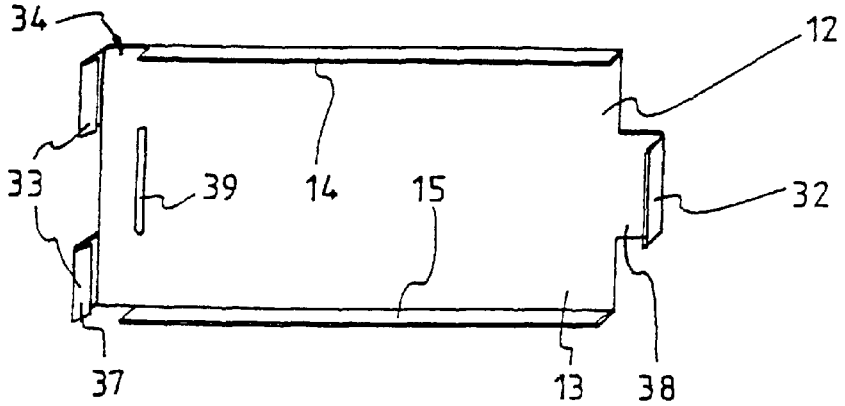
FIG. 5 shows a fourth possible embodiment of a reinforcement plate according to the invention.

However, with the embodiments of the reinforcement plates 12 which are illustrated in FIGS. 4 and 5 it is possible to attach the same reinforcement plates at the same height between a plurality of successive uprights 8. The mounting plate 12 in accordance with FIG. 4 essentially corresponds to the mounting plate 12 in accordance with FIG. 3. However, instead of the flanged edge 32 the mounting plate in accordance with FIG. 4 comprises two flanged parts 36 which are parallel to the flanged edges 14, 15 and lie in line with these flanged edges. The opening 35, in which the side wall 10 of an upright 8 can be received, is situated between the flanged edges 14, 15 and the flanged part 36. Two mounting plates 12 of this kind can be placed next to one another between successive uprights 8, the flanged parts 36 of one mounting plate 12, after they have been arranged around an upright 8, partially overlapping the upper edge 14 and the lower edge 15 of the adjacent mounting plate 12.

The embodiment in accordance with FIG. 5 also largely corresponds to the embodiment in accordance with FIG. 3. However, in the case of this mounting plate 12 in accordance with FIG. 5, the flanged edge 31 is divided into two parts 37, which are each arranged in the region of one corner of the mounting plate 12. The edge 32 on the other side of the mounting plate 12, together with the adjoining part 38 of the surface 13, is narrowed to a width which essentially corresponds to the distance between the parts 37 on the opposite side. Parallel to the flanged parts 37, a slot 39 is made in the surface 13, at a distance from the edge 31. This distance corresponds to the width of a side wall 10 of an upright 8. The length of the slot 39 essentially corresponds to the length of the flanged edge 32. The distance from the slot 39 to the upper edge 14 and lower edge 15, respectively, essentially corresponds to the distance from the flanged edge 32 to the upper and lower edges, respectively. By hooking the flanged edge 32 of one mounting plate 12 into the slot 39 of the adjacent mounting plate 12, it is possible to suspend a plurality of mounting plates 12 on a plurality of adjacent uprights 8 of a wall.

What is claimed is:

1. A wall system comprising a plurality of pillars, including a first pillar and a second pillar, spaced at a specific distance from one another, each of said pillars comprising a C-shaped profile part having a pair of opposite sidewalls joined by a rear wall, said pillars for mounting wall boards to form a partition wall, said wall system further comprising at least one mounting plate for locally reinforcing said partition wall and for mounting items to said partition wall, wherein said mounting plate (12) comprises a planar metal plate having a first end opposite a second end, each of said first and said second ends having connectors formed from portions of said plate, said connectors of said first end connecting said plate to said first pillar in a clamping fit by engaging said first pillar and said connectors of said second end connecting said plate to said second pillar in a clamping fit by engaging said second pillar.

2. A wall system according to claim 1, wherein said connectors are adapted for fixing said mounting plate in a first horizontal direction, transverse to said mounting plate (12) with regard to said first and said second pillars (8).

3. A wall system according to claim 1, in which each of said connectors (17, 20) engage about both sides of one of said sidewalls of one of said first and said second pillars (8), said pillars situated substantially parallel to a plane of the wall.

4. A wall system according to claim 1 wherein each of said connectors engage both a rear side and a front side of one of said sidewalls of one of said first and said second pillars (8).

5. A wall system according to claim 2, wherein at least one of said connectors further comprises a first connecting part (12, 21) formed from said plate (12) and a second connecting part (20, 17) formed from said plate (12), said first connecting part and said second connecting part cooperating to clamp one of said first and said second pillars in the first horizontal direction in between them.

6. A wall system according to claim 1, wherein said connectors are adapted for fixing said mounting plate in a horizontal direction, parallel to said mounting plate (12), with regard to said first and said second pillars (8).

7. A wall system according to claim 1 wherein each of said sidewalls of each of said pillars includes a flanged edge, said flanged edge being substantially sides of said flanged edge of one of said sidewalls.

8. A wall system according to claim 6 wherein said connectors further comprise a first connecting part (17) formed from said plate (12) and a second connecting part (20) formed from said plate (12), said first connecting part and said second connecting part cooperating with successive pillars to clamp said plate (12) in said horizontal direction in between said successive pillars, said first and second connecting parts of said plate maintaining said first and said second pillars a fixed distance apart from one another.

9. A wall system according to claim 1, wherein a portion of said connectors comprise hook-shaped members that engage said first pillar in a clamping fit and wherein another portion of said connectors comprise gripping members that engage said second pillar in a clamping fit, said first pillar placed adjacent to said second pillar.

10. A wall system according to claim 9, wherein said plate (12) comprises a rectangular planar part, said rectangular planar part including a projecting upper edge opposite a projecting lower edge, said upper and said lower edges bent over at an angle of approximately 90 degrees with respect to said rectangular planar part, said projecting upper edge and said projecting lower edge each having a first end opposite a second end, each of said second ends of said protecting upper edge and said projecting lower edge including an L-shaped part, said L-shaped parts forming said gripping members which engage a side wall of said second pillar in a clamping fit; said first ends of each of said protecting upper edge and said projecting lower edge including an extension having a cut out, said extension and said cut out forming said hook-shaped members, said hook-shaped members each engaging a flanged edge of one of said sidewalls of said first pillar in a clamping fit.

11. A wall system according to claim 1, wherein said plate includes a rectangular planar part having a projecting upper edge opposite a projecting lower edge, said upper and said lower edges bent over at an angle of approximately 90 degrees with respect to said rectangular planar part, said rectangular planar part further having a first side edge opposite a second side edge, said side edges located between said upper projecting edge and said lower projecting edge, said first side edge having a protruding portion and said second side edge having a cut out with a contour that matches the contour of said protruding portion, said protruding portion and said cut out each forming a portion of said connectors and being on a front side of said planar part.

12. A wall system according to claim 11, wherein said protruding portion has a trapezoid shape.

13. A wall system according to claim 1, wherein said plate (12) includes a rectangular planar part, having an upper projecting edge opposite a lower projecting edge, said projecting edges bent at an angle of approximately 90 degrees relative to said rectangular planar part and each of said projecting edges having a length corresponding to the distance between said first pillar and said second pillar; said planar part further including a first side edge opposite a second side edge, said first side edge and said second side edge being generally perpendicular to said upper projecting edge and said lower projecting edge, said first side edge and said second side edge both bent at an angle of approximately 90 degrees with respect to said planar part, and wherein the distance between said first side edge and said second side edge is approximately equal to the distance between said first pillar and said second pillar plus two times the width of said first pillar.

14. A wall system according to claim 1, wherein said plate includes a rectangular planar part having an upper projecting edge opposite a lower projecting edge, said projecting edges bent at an angle of approximately 90 degrees with respect to said planar part, said upper projecting edge including an opening aligned with an opening in said lower projecting edge said openings of said upper projecting edge and said lower projecting edge receiving a sidewall of said first pillar;

said planar part further including a side edge bent at an angle of approximately 90 degrees relative to said planar part and being generally perpendicular to said upper projecting edge and said lower projecting edge, said side edge being spaced from said upper projecting edge and said lower projecting edge, said second pillar received between said side edge and said upper projecting edge and said lower projecting edge.

15. A wall system according to claim 1, wherein said plate includes a rectangular planar part having an upper projecting edge opposite a lower projecting edge, said upper and said lower projecting edges bent at an angle of approximately 90 degrees relative to said planar part and the length of said upper projecting edge and said lower projecting edge being approximately equal to the distance between said first pillar and said second pillar;

said planar part further including a first side edge opposite a second side edge, said side edges being generally perpendicular and spaced apart from said upper projecting edge and said lower projecting edge, said first side edge comprising a pair of spaced apart flanges, said flanges bent at an angle of approximately 90 degrees relative to said planar part, and said second pillar received between said flanges and said upper projecting edge and said lower projecting edge in a clamping fit;

said second side edge of said planar part having a flange bent at an angle of approximately 90 degrees relative to said planar part, said flange having a length corresponding to the distance between said flanges of said first side edge, said first pillar received between said flange of said second side edge and said upper projecting edge and said lower projecting edge; and said planar part including a slot adjacent said first side edge, the length of said slot being approximately equal to the length of said flange of said second side edge.

* * * * *

UNITED STATES PATENT AND TRADEMARK OFFICE

CERTIFICATE OF CORRECTION

PATENT NO. : 6,253,529 B1
DATED : July 3, 2001
INVENTOR(S) : Hermanus Petrus Maria De Boer It is certified that error appears in the above-identified patent and that said Letters Patent is hereby corrected as shown below:

Column 5,
Line 17, insert -- perpendicular to a plane of said wall and wherein each of said connectors engage both -- after "substantially".

Signed and Sealed this

Fourteenth Day of May, 2002

*Attest:*

*Attesting Officer*

JAMES E. ROGAN
*Director of the United States Patent and Trademark Office*